US007878795B2

(12) United States Patent
Bohan, Jr.

(10) Patent No.: US 7,878,795 B2
(45) Date of Patent: Feb. 1, 2011

(54) BURNER IGNITION CONTROLLER

(75) Inventor: John E. Bohan, Jr., Avon Lake, OH (US)

(73) Assignee: R.W. Beckett Corporation, North Ridgeville, OH (US)

( * ) Notice: Subject to any disclaimer, the term of this patent is extended or adjusted under 35 U.S.C. 154(b) by 45 days.

(21) Appl. No.: 11/764,952

(22) Filed: Jun. 19, 2007

(65) Prior Publication Data

US 2008/0293001 A1 Nov. 27, 2008

Related U.S. Application Data

(60) Provisional application No. 60/939,557, filed on May 22, 2007.

(51) Int. Cl.
*F23N 5/20* (2006.01)

(52) U.S. Cl. ..... 431/76; 431/6; 431/27; 431/69; 431/70; 126/116 A; 700/12; 700/14; 318/661

(58) Field of Classification Search ..... 431/76, 431/6, 27, 70, 30, 18, 29, 31, 1, 78, 11, 2, 431/74, 36, 26, 45, 46, 69, 25; 126/116 A; 318/661; 700/12, 14
See application file for complete search history.

(56) References Cited

U.S. PATENT DOCUMENTS 3,830,619 A * 8/1974 Cade ..... 431/78
4,395,224 A * 7/1983 Cade ..... 431/31
4,695,246 A 9/1987 Beilfuss et al.
5,263,851 A * 11/1993 Hosome et al. ..... 431/79
5,271,556 A 12/1993 Helt et al.
5,364,260 A * 11/1994 Moore ..... 431/6
5,520,159 A * 5/1996 Pao et al. ..... 123/568.27
5,599,179 A * 2/1997 Lindner et al. ..... 431/12
5,997,280 A * 12/1999 Welz et al. ..... 431/90
6,175,207 B1 1/2001 Melcher et al.
6,227,842 B1 * 5/2001 Lemelson et al. ..... 431/12
6,247,918 B1 * 6/2001 Forbes et al. ..... 431/12
6,389,330 B1 * 5/2002 Khesin ..... 700/274
6,413,078 B1 7/2002 Melcher et al.
6,478,574 B1 11/2002 Melcher et al.
6,494,707 B1 12/2002 Melcher et al.
2003/0087213 A1 * 5/2003 Reifel et al. ..... 431/11
2004/0209209 A1 * 10/2004 Chodacki et al. ..... 431/66

* cited by examiner

*Primary Examiner*—Steven B McAllister
*Assistant Examiner*—Avinash Savani
(74) *Attorney, Agent, or Firm*—Eschweiler & Associates, LLC

(57) ABSTRACT

A fuel burner controller and associated method is configured to establish fuel combustion in a fuel burner and to recycle a fuel combustion initiation process when a loss of combustion is detected and a call for heat is asserted. The controller is further configured to limit a number of recycles of the fuel combustion initiation process based on a time budget.

17 Claims, 6 Drawing Sheets

BURNER IGNITION CONTROLLER

REFERENCE TO RELATED APPLICATION

This application claims priority to and the benefit of U.S. Provisional Application Ser. No. 60/939,557 which was filed May. 22, 2007, entitled BURNER IGNITION CONTROLLER, the entirety of which is hereby incorporated by reference as if fully set forth herein.

FIELD OF INVENTION

The present invention relates generally to a fuel burner controller that employs a time budget system to limit an amount a fuel burner will recycle under particular fuel burner conditions.

BACKGROUND OF THE INVENTION

Fuel burner systems for use in furnaces, boilers, water heaters etc. are well known in the prior art. One type of fuel burner is an oil burner, and is employed in various types of apparatus, such as boilers, furnaces, water heaters, etc. In such applications, an oil burner receives a fuel oil and initiates combustion thereof to generate heat which is then employed in various manners to perform work. Although several types of oil burners exist, one exemplary oil burner is illustrated in prior art FIG. 1, and is designated at reference numeral 10. The oil burner 10 comprises a blower housing 12 having an air tube 14 extending therefrom. The air tube 14 contains a combustion head affixed or positioned at one end 16 of the air tube opposite the housing 12, the end 16 having a nozzle and electrode assembly (not shown) positioned thereat. The nozzle is coupled to a fuel pump 18 by a fuel or nozzle line (a portion of which is highlighted at 20) for delivery of fuel oil thereto. The electrode assembly in the air tube 14 is coupled to a transformer or other type ignition device 22 residing on a top portion 24 of the housing 12.

As seen in prior art FIG. 2, the fuel pump 18 is axially driven by a drive shaft 26 associated with a motor 28 located on an opposite face 30 of the housing 12. The drive shaft 26 also drives a blower wheel 32 within the housing 12 for providing air into the air tube 14 for combustion via an air inlet portion 33 in the housing 12. The motor 28 is controlled by an electronic control module 34. The electronic control 34 operates to initiate delivery of oil, air and spark to the ignition head at 16 based on a call for heat from a thermostat (not shown), for example. The controller 34 may also operate to re-initiate ignition if combustion is discontinued unexpectedly and may further discontinue delivery of oil to the nozzle if ignition cannot be re-established within a predetermined lock-out time period (sometimes referred to as a safety lock-out condition).

Various types of controllers exist for oil burners. The controller 34 illustrated in prior art FIGS. 1 and 2 represents one basic type of controller that is used extensively. The controller 34 initiates air flow and fuel delivery substantially simultaneously via the motor drive shaft, while concurrently initiating spark at the head via a signal to the transformer 22. A flame detector such as a cad cell views the combustion area to determine whether or not combustion has occurred. The controller 34 receives a signal from the thermostat and acts to control the operation of the oil burner 10. More particularly, when the thermostat sends a signal calling for more heat, the controller sends a signal to the igniter 22 that then operates to produce a spark across the gap between the electrodes. The controller 34 also sends a signal to energize the motor 28, the blower 32 and the pump 18 to start the mist of oil and air flowing from the blower section to the combustion chamber. If the oil and air are present and the spark ignites the oil, then the flame detector provides a signal to the controller 34 to indicate that satisfactory combustion has occurred. Thereafter, the igniter 22 turns off (referred to as "interrupted" operation) and the furnace produces heat until the call for heat is lost and the motor 28, the pump 18 and the igniter 22 are shut off.

In a normal operation of the system, when a call for heat is identified from the thermostat, the controller 34 starts the ignition process, wherein flame is established and the system enters a run mode or run state. In the run state the furnace supplies heat until the call for heat from the thermostat disappears. Sometimes in the normal run state, the flame can go out before the call for heat from the thermostat ends. This condition is sometimes caused by a transitory condition such as an air bubble in the fuel line. When the flame in the burner goes out after having been established and before the thermostat stops calling for heat, the system goes into a recycle mode which, after a delay (recycle time), the system reverts to an initial state. In this initial state, since the controller 34 still receives the continued call for heat from the thermostat, the controller 34 starts the ignition process and again attempts to initiate a flame. If successful the system then returns to its normal run state. Unfortunately, the condition causing the loss of flame condition may not have disappeared; for example, when the system does not support combustion after the igniter 22 turns off. When this occurs, the flame will again extinguish, thus putting the system back in the recycle mode again and an endless cycle to the run mode and recycle mode may occur. This endless recycling is often due to a poor combustion situation and thus excessive soot may develop, excessive wear on components may result, and other damage may occur.

One prior art controller addressed the potential problems associated with the endless recycle condition by limiting a number of recycle attempts to a predetermined number, after which the system entered a lockout state. It is always desirable to provide further improvements in controller devices and methodologies.

SUMMARY OF THE INVENTION

The following presents a simplified summary in order to provide a basic understanding of one or more aspects of the invention. This summary is not an extensive overview of the invention, and is neither intended to identify key or critical elements of the invention, nor to delineate the scope thereof. Rather, the primary purpose of the summary is to present some concepts of the invention in a simplified form as a prelude to the more detailed description that is presented later.

The invention is directed to a fuel burner controller and related methods that is operable to provide various control signals to establish combustion upon a call for heat. In the event that a loss of flame is detected during a call for heat, the controller initiates a recycle procedure in which an attempt to re-establish combustion is performed. The controller employs a time budget management system that attempts to minimize the amount of time the fuel burner is permitted to attempt to establish combustion in circumstances where the burner is unable to properly sustain a flame.

In one embodiment of the invention, when an initial call for heat is provided by the thermostat, an initial time budget for achieving ignition is established or otherwise provided. If successful ignition and continued combustion cannot be established prior to the depletion of the timing budget during the uninterrupted call for heat, the controller enters a lockout state, or otherwise discontinues further attempts to re-establish combustion.

To the accomplishment of the foregoing and related ends, the following description and annexed drawings set forth in detail certain illustrative aspects and implementations of the invention. These are indicative of but a few of the various ways in which the principles of the invention may be employed. Other aspects, advantages and novel features of the invention will become apparent from the following detailed description of the invention when considered in conjunction with the drawings.

DETAILED DESCRIPTION OF THE INVENTION

Figure 1:
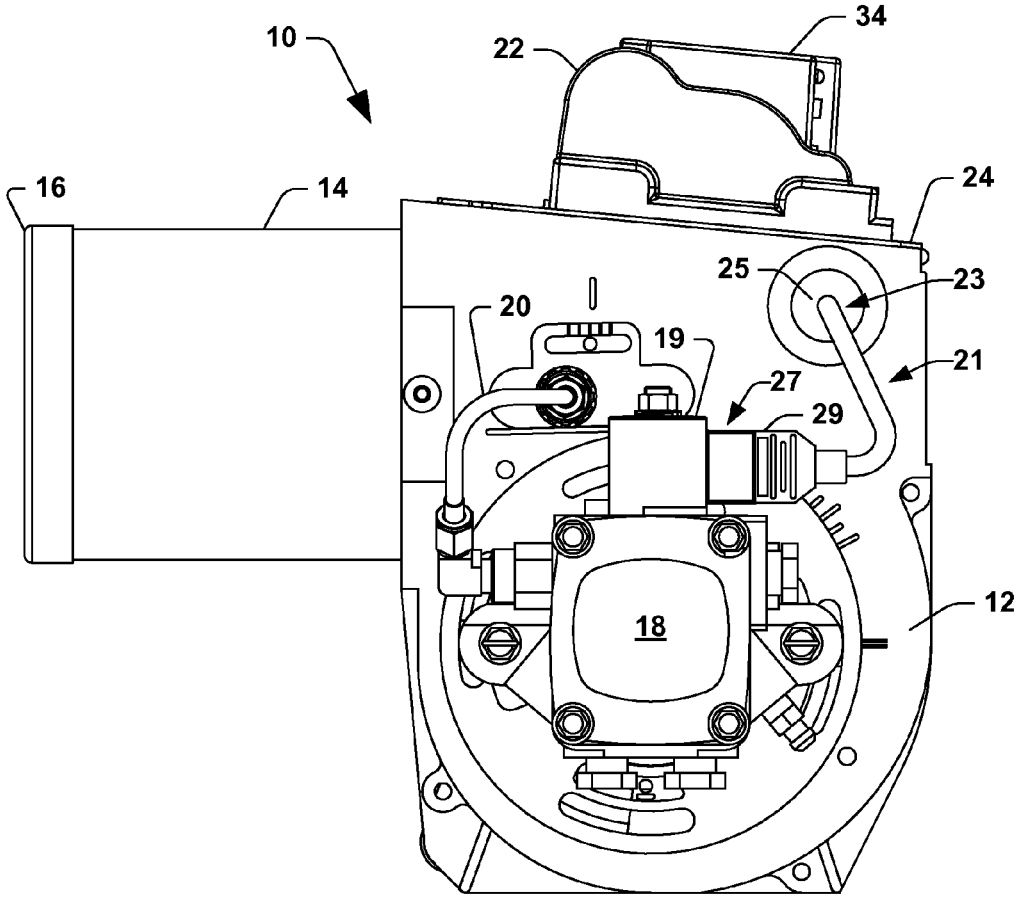
FIG. 1 (PRIOR ART)
FIG. 1 is a prior art side elevation view of an oil burner and various burner components associated therewith.
Figure 2:
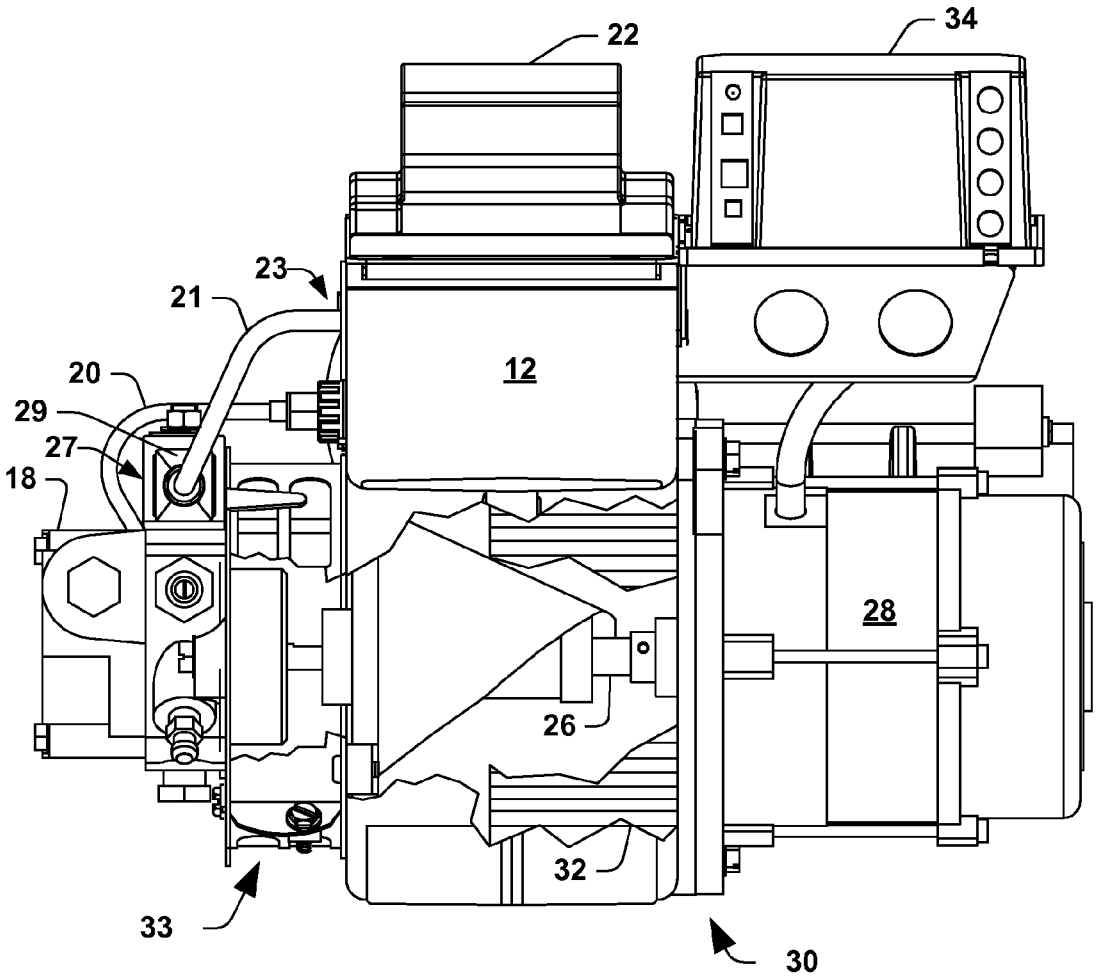
FIG. 2 (PRIOR ART)
FIG. 2 is a rear elevation view of the oil burner of FIG. 1 illustrating various burner components associated therewith.

The present invention will now be described with reference to the attached drawings, wherein like reference numerals are used to refer to like elements throughout. The invention is directed to a fuel burner controller that is operable to provide various control signals to establish combustion upon a call for heat. In the event that a loss of flame is detected during a call for heat, the controller initiates a recycle procedure in which an attempt to re-establish combustion is performed. The controller employs a time budget management system that attempts to minimize the amount of time the fuel burner is permitted to attempt to establish combustion in circumstances where the burner is unable to properly sustain a flame.

In one embodiment of the invention, when an initial call for heat is provided by the thermostat, an initial time budget for achieving ignition is established or otherwise provided. If successful ignition and continued combustion cannot be established prior to the depletion of the timing budget during the uninterrupted call for heat, the controller enters a lockout state, or otherwise discontinues further attempts to re-establish combustion.

Figure 3:
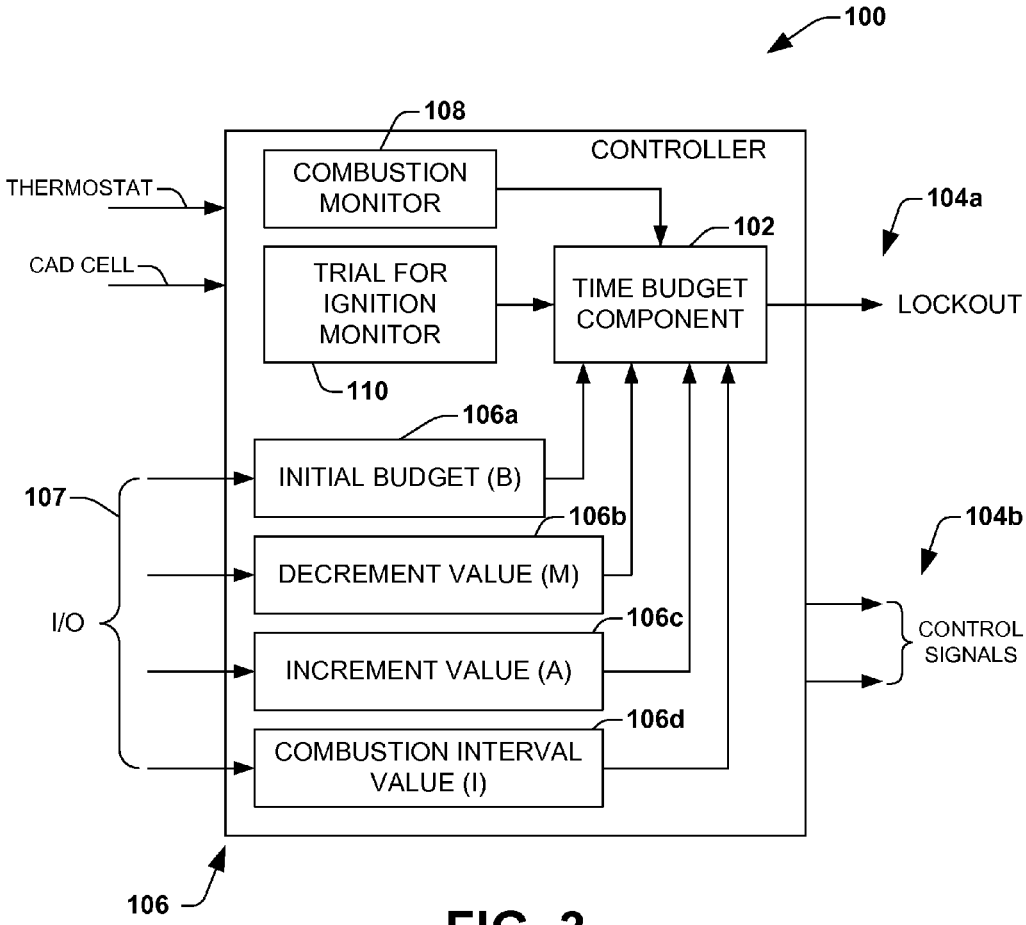
FIG. 3 is a block diagram illustrating a controller for a fuel burner operable to perform a limited recycle of a burner based on a time budget according to one embodiment of the invention.

Turning now to the figures, FIG. 3 is a block diagram illustrating a fuel burner controller 100 according to one embodiment of the invention. While the present description example is directed to an oil burner, it should be appreciated that the present invention contemplates control of any type of fuel burner, such as a gas burner. Any type of fuel burner control application is contemplated as falling within the scope of the present invention. The controller 100 comprises a time budget component 102 that receives a plurality of pieces of data, and provides one or more outputs, directly or indirectly, that relates to various output control signals 104*a* and 104*b*.

In one embodiment of the invention, the time budget component 102 comprises a combination of hardware and software configured to perform the various control functions to be described infra. However, it should be appreciated that the time budget component 102 may comprise a total hardware or total software solution, or any combination thereof, and all such alternatives are contemplated as falling within the scope of the present invention.

Still referring to FIG. 3, the controller 100 further comprises various memory locations 106 that contain one or more pieces of data for use by the time budget component 102. In one embodiment, the memory locations 106 may comprise individual data registers or address locations within a contiguous memory that is dedicated for such data or is general in nature and contains other data employed for other functions of the controller 100. Any type of data storage component or components may be utilized and all such variations are contemplated as falling within the scope of the invention.

In one embodiment of the invention, the memory locations 106 comprise an initial time budget location 106*a*, a decrement value location 106*b*, an increment value location 106*c*, and a combustion interval value location 106*d*. In one embodiment of the invention, each memory location can be loaded externally via one or more I/O ports 107, thereby allowing each of the memory locations to have their data dynamically altered or programmed by a user, such as a service technician, for example. In another alternative embodiment, such data locations may have their data fixed, such as in a burned ROM type memory. Any type of dynamic or static memory configurations may be employed in accordance with the invention.

In one embodiment of the invention, the initial time budget memory location 106*a* contains an initial budget value (B) that represents an amount of time that the fuel burner will be permitted to establish combustion during an uninterrupted call for heat. In one example of the invention, the value (B) is thirty (30) seconds, however, any initial value may be employed, and all such variations are contemplated as falling within the scope of the present invention. The decrement value memory location 106*b* holds a decrement value (M) that may be selectively employed by the time budget component 102 in decrementing either the initial time budget value (B) or an adjusted time budget value, as will be described in greater detail infra.

The memory locations 106 may further comprise an increment memory location 106*c* that holds an increment value (A), and a combustion interval location 106*d* that holds a combustion interval value (I). These locations are associated with an alternative embodiment of the invention, and may be employed to adjust a previously adjusted time budget in a positive manner based upon an extended period of time in which successful combustion has been maintained. For example, for each amount of time (I) that successful combustion is maintained, the time budget component 102 may increment an adjusted time budget by an increment amount (A). Alternatively, however, the controller 100 may use such pieces of data differently to manipulate an adjusted time budget, and all such variations are contemplated as falling within the scope of the present invention.

The time budget component 102 also receives data from a combustion monitor 108 and a trial for ignition monitor 110. In one embodiment, each monitor 108, 110 comprises a time or a counter that is operable to ascertain a time associated with a particular activity or operation, however, any type of monitor may be employed, and all such alternatives are contemplated as falling within the scope of the present invention. In addition, while FIG. 3 may illustrate the monitors 108, 110 as separate components, such components may be separate or integral, and may comprise hardware or software, or a combination thereof, and all such variations are contemplated as falling within the scope of the invention.

In one embodiment of the invention, a trial for ignition time budget is established for each new call for heat. For example, when a thermostat issues a call for heat, the time budget component 102 retrieves an initial time budget value (B) from the memory location 106*a*. The controller 100 then triggers the trial for ignition monitor 110 as the controller attempts to successfully establish combustion. The time necessary to successfully establish combustion is called, in one example, the actual trial for ignition time period, and this value (which will vary based upon system performance) is decremented from the initial time budget, thereby resulting in an adjusted time budget. In one embodiment, the cad cell input to the controller 100 provides the information that combustion has been established, and the trial for ignition monitor 110 ascertains the actual trial for ignition time period from the monitor 110 with the decrement value (M) from the memory location 106*b*, and uses the larger of these two values to reduce the initial time budget value (B) down to the adjusted time budget value. Upon a loss of flame, the controller 100 performs a recycle operation to re-establish combustion. As will be appreciated, the amount of time needed to re-establish combustion is again ascertained by the monitor 110, and the adjusted time budget is again adjusted by the time budget component 102.

In the event that the adjusted time budget value reaches a predetermined limit (e.g., zero (0)), the time budget component 102 communicates that condition so that the controller 100 enters a particular mode, such as a lockout mode, wherein a manual reset of the controller is required to restart normal operation. As may be appreciated, the number of times that flame may be lost and re-established during a single uninterrupted call for heat before lockout condition occurs is indeterminate.

In accordance with another embodiment of the invention, the adjusted time budget can be adjusted in a different fashion by the time budget component 102 when the fuel burner runs successfully for an extended period of time without being interrupted by a loss of flame during the call for heat time period. For example, the adjusted time budget can be adjusted by having time added thereto. In one embodiment of the invention, the adjusted time budget may be adjusted in an incrementing fashion in positive increments of (A) provided by the increment value memory location 106*c* for each (I) seconds that the fuel burner experiences successful combustion without interruption. In one example, if A=5 seconds and I=20 seconds, then for each 20 seconds combustion is successfully maintained, the adjusted time budget is increased by 5 seconds. In one embodiment of the invention, the adjusted time budget can be increased up to a maximum limit value, such as the initial time budget value (B). Therefore if combustion were successfully maintained for 50 seconds prior to losing flame, an adjusted time budget could be increased by a value of 10 seconds, wherein 50/20=2 (dropping the remainder), and 2×A=2×5=10 seconds.

As can be further appreciated from the discussion above, the number of recycle attempts that the controller 100 may perform before a lockout condition occurs is indeterminate. For example, based upon the initial time budget value (B), the actual trial for ignition period (provided or ascertained by the monitor 110), the decrement value (M), and whatever a prolonged successful operation of the fuel burner without loss of flame causes positive adjustments to the adjusted time budget (e.g., based on the value of A and I), the actual number of recycles that may occur prior to a lockout condition may vary.

Figure 4:
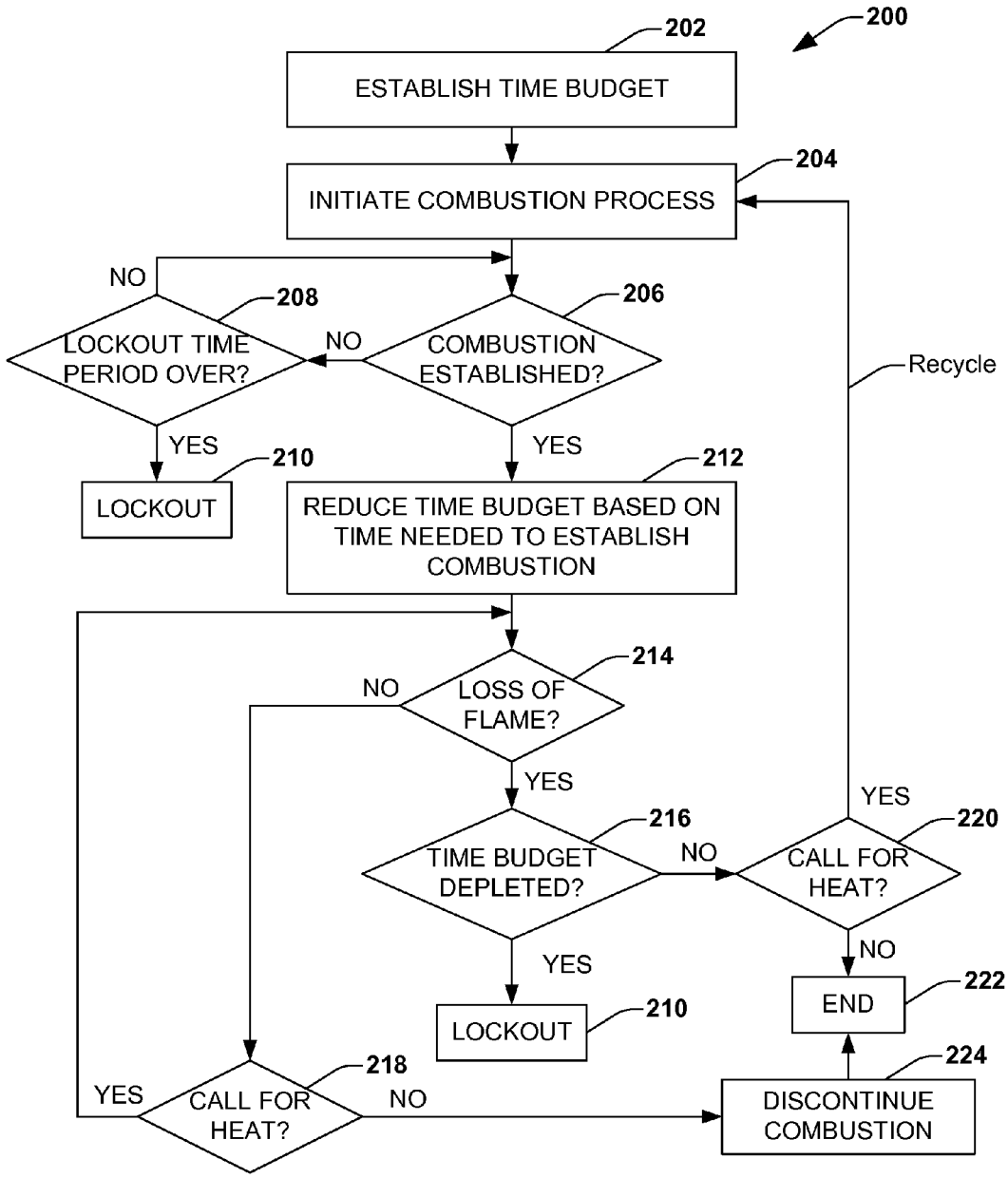
FIG. 4 is a flow chart illustrating a method of performing a limited recycle operation in conjunction with a fuel burner using a time budget according to another embodiment of the invention.

Turning now to FIG. 4, a method of controlling a fuel burner by employing a time budget management system protocol is disclosed, as provided generally at reference numeral 200. While the method and other methods of the invention are illustrated and described below as a series of acts or events, it will be appreciated that the present invention is not limited by the illustrated ordering of such acts or events. For example, some acts may occur in different orders and/or concurrently with other acts or events apart from those illustrated and/or described herein, in accordance with the invention. In addition, not all illustrated actions may be required to implement a methodology in accordance with the invention.

The method 200 begins at 202, wherein an initial time budget is established. Act 202 may comprise a predetermined programmed value, or may comprise a user input value that is programmable and retrieved from a memory location. Alternatively, any manner of establishing the initial time budget value may be employed and all such alternatives are contemplated as falling within the scope of the present invention. The method 200 further comprises initiating a combustion process at 204. In one embodiment, 204 may comprise receiving a call for heat from a thermostat, and initiating one or more control signals to initiate combustion, for example, starting a blower, opening a solenoid valve to introduce fuel, and triggering an igniter to ignite fuel in a combustion chamber.

A query is made at 206 whether combustion has been established, for example, by monitoring a cad cell or other flame sensor signal that detects flame in the combustion chamber. If the response to the query is negative (NO at 206), the method 200 performs another query at 208 to ascertain whether a lockout time period is over. If not (NO at 208), the method 200 loops back to 206 to determine if combustion is established. If combustion is not successfully achieved within the lockout time period (YES at 208), a lockout condition is entered at 210, wherein a manual reset or other action is required to proceed.

If, however, combustion is successfully achieved within the lockout time period (YES at 206), the method proceeds to 212, wherein the present time budget value (e.g., in this instance the initial time budget value) is adjusted (e.g., decremented). In one embodiment of the invention, the present time budget value is reduced by an amount that is related to the amount of time it took to establish combustion at 206. Alternatively, the time budget may be adjusted by a constant value; and in another embodiment a larger amount of the actual trial for ignition period and a constant is employed to adjust the present time budget value.

Upon the adjustment performed at 212, the method 200 proceeds to 214, wherein a determination is made whether flame has been lost. If not (NO at 214), another query is made whether a call for heat exists at 218. If so (YES at 218), the method 200 returns to 214. If not (NO at 218), combustion is discontinued at 224 and the method 200 ends at 222.

If a loss of flame is detected at 214 (YES), another query is made whether the time budget is depleted at 216. In one embodiment of the invention, the adjusted time budget is considered to be depleted when a predetermined relationship is established between the adjusted time budget value and a predetermined value. In one example, the adjusted time budget is considered to be depleted when it reaches a predetermined value such as zero (0).

Alternatively, however, other relationships may be employed, and all such control algorithms are contemplated as falling within the scope of the present invention.

If the adjusted time budget has been depleted (YES at 216), the controller enters a lockout state at 210. If, however, the adjusted time budget has not been depleted (NO at 216), the method 200 makes additional queries. For example, a verification is made whether the call for heat is still asserted at 220. If not (NO at 220), the thermostat is no longer calling for heat, and the method 200 can end at 222, or loop back to 202. However, if a loss of flame has occurred and a call for heat still exists (YES at 220), then the method 200 proceeds to 204 and the controller again initiates combustion. This attempt to re-establish ignition is a recycle operation. Once combustion is again re-established (YES at 206) the adjusted time budget is again adjusted based on an amount of time needed to re-establish combustion. If the gain adjusted time budget becomes depleted (YES at 214) the controller continues at 216.

As can be seen above, the method 200 of FIG. 4 provides for a combustion initiation process that employs a recycle procedure in instances where flame is lost during an uninterrupted call for heat. However, entry into a lockout mode is not predicated upon a specific number of recycle attempts, but instead relies upon management of a time budget. Once the time budget has become depleted, the method 200 enters lockout, independent of a number of times a recycle operation is performed.

Figure 5:
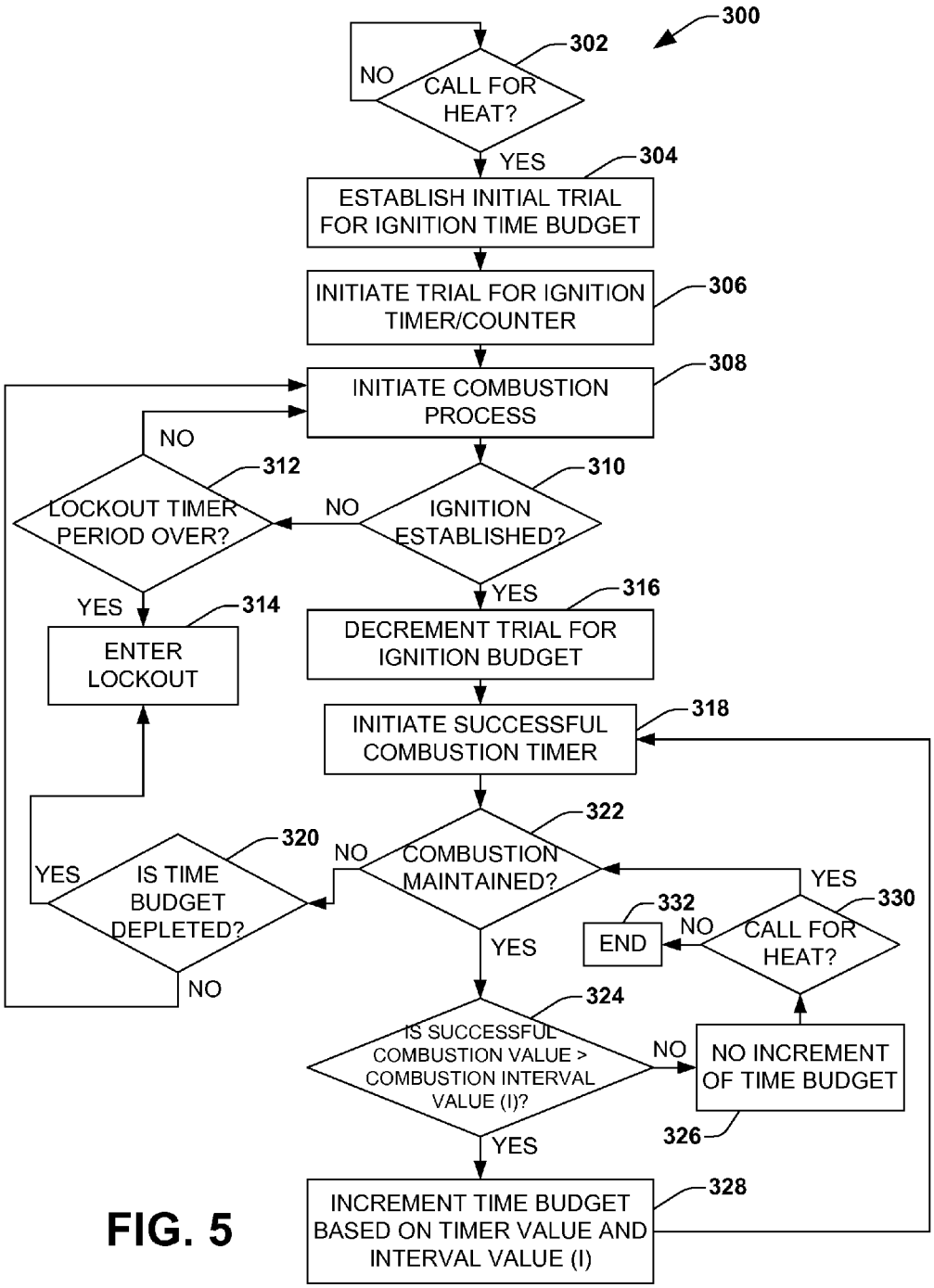
FIG. 5 is a flow chart illustrating a method of performing a limited recycle operation in conjunction with a fuel burner using a time budget according to yet another embodiment of the invention.

Turning now to FIG. 5, another method of controlling a fuel burner using a time budget management protocol is illustrated at reference numeral 300. The method 300 differs from the method 200 of FIG. 4 due to, among other things, the further adjustment of an adjusted time budget based upon a prolonged period of successful combustion during an uninterrupted call for heat. In one embodiment of the invention, the adjusted time budget is adjusted in an increment or positive adjustment fashion by an amount that is related to the period in which successful combustion is maintained.

The method 300 begins at 302, wherein upon a detected call for heat (YES at 302), an initial trial for ignition time budget is established at 304. A trial for ignition timer, counter or other type monitor is initiated at 306 while the combustion process is concurrently started at 308. A query is made at 310 whether ignition has been established. If not (NO at 310), another query is made at 312 as to whether a lockout time period is over. If so (YES at 312), the method 300 has the controller at a lockout state at 314. If not (NO at 312), the method 300 proceeds to 308, wherein an attempt to initiate combustion continues.

If combustion is established (YES at 310), the state of the trial for ignition timer, counter or monitor is employed to decrement the initial trial for ignition time budget at 316, while concurrently a combustion timer or other type monitor is activated at 318. Another query is made as to whether combustion still exists at 322. If not (NO at 322), another query is made at 320 whether the adjusted time budget has been depleted. If the time budget is depleted YES at 320), the method 300 enters lockout at 314. If not (NO at 320), an attempt is made to re-establish ignition at 308. If combustion is maintained at 322, still another query is made at 324 at to whether the amount of time successful combustion was maintained (as provided by the combustion counter or timer that started at 316) is greater than a combustion interval value (I). If not (NO at 324), then no increment of the adjusted time budget is made at 326. The method 300 then continues to monitor whether the call for heat still exists at 330, and if so (YES at 330), the method continues with the query at 322, and if not (NO at 328, the method 300 ends at 332.

If the time period of successful combustion exceeds the combustion interval value (I) (YES at 324), then an adjustment of the adjusted time budget occurs at 328. In one embodiment, the adjusted time budget is adjusted by a value based on the value of the combustion timer (X), the interval value (I), and the increment value (A). In one particular embodiment, the adjustment amount is equal to (X/I)A, wherein if the dividend (X/I) is not an integer, the remainder associated therewith is dropped. Alternatively, the increment adjustment amount may be any other value according to other algorithms, and all such variations are contemplated as falling within the scope of the present invention. Further, any incrementation may also be limited to some predetermined maximum amount such as, for example, limiting the positive adjustment to a maximum of the initial time budget. The method 300 then continues at 318.

As can be seen above, the method 300 of FIG. 5 provides for a combustion initiation process that employs a recycle procedure in instances where flame is lost during an uninterrupted call for heat. However, entry into a lockout mode is not predicated upon a specific number of recycle attempts, but instead relies upon management of a time budget that can be decremented and/or incremented based on various factors. Once the time budget has become depleted, the method 300 causes the controller to enter lockout, independent of a number of times a recycle operation is performed.

For example, if the initial ignition time budget (B) is 30 seconds (B=30), the minimum decrement time (M) is 10 seconds (M=10), the added time increment (A) is 5 seconds (A=5), and the continuous run-time increment required to add time to the time budget (I) is 30 seconds (I=30), the control operation may run as follows.

Figure 6:
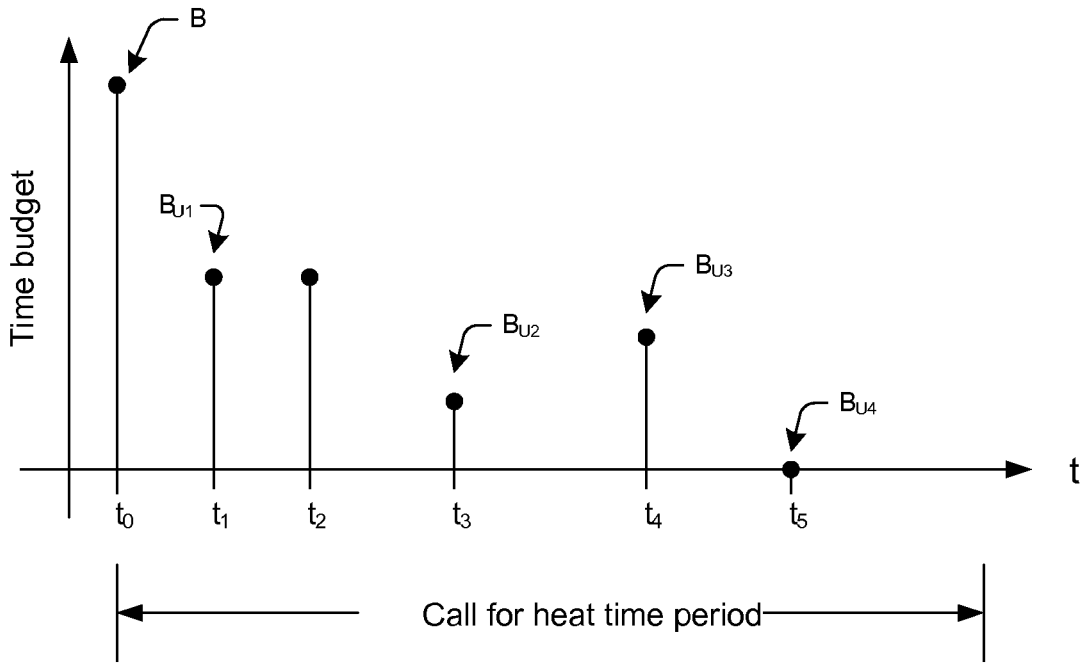
FIGS. 6 and 7 are diagrams illustrating variations in a time budget using a controller in accordance with an embodiment of the invention.

At the time of the initial call for heat, the above initial variables are loaded during initialization, for example, at $t_0$, as illustrated in FIG. 6. The actual trial for ignition time period (U) needed to successfully establish flame (e.g., including any ignition carryover) in this first example is 15 seconds (U=15). Since this time duration is grater than the minimum decrement time (M=10), the time budget is adjusted by decrementing the initial time budget by the actual trial for ignition period ($B_{U1}$=B−U; 15=30−15). This adjustment is illustrated in FIG. 6 at $t=t_1$.

The time period in which the flame is successfully maintained is then measured. If a loss of flame occurs at $t_2$, twenty (20) seconds after flame was established, then no time is added to the adjusted time budget. This is because the minimum time necessary to add time (I) is 30 seconds. Because flame has been lost and a call for heat still exists, the controller 100 (or associated method) performs a recycle (recycle #1) in which ignition is re-attempted. If the actual trial for ignition time in this second attempt is 8 seconds (U=8), then the adjusted time budget is adjusted at $t_3$ by 10 seconds. This decrement value of 10 is employed because U=8, and the minimum decrement time (M) is predetermined to be 10 seconds in this example. Therefore $B_{U2}=B_{U1}-M=5$, because 5=15−10), as illustrated in FIG. 6.

Continuing, if successful flame is maintained for 45 seconds until a loss of flame occurs at $t_4$, extra time is added to the adjusted time budget in the amount of 5 seconds to form a new adjusted time budget $B_{U3}$ of 10 seconds. This occurs because the successful flame period (X) is greater than I (I=30) and X/I=1 (drop the remainder), and the added time increment A is 5 seconds. Therefore $B_{U3}=B_{U2}+(X/I)A=10$ (10=5+(1)(5)). This adjustment is illustrated in FIG. 6 at $t_4$.

Since flame has been lost and the call for heat still exists, the invention again enters the recycle mode (recycle #2), and an attempt is again made to establish flame. If the actual trial for ignition time (U) in this attempt is 13 seconds, then $B_{U4}=B_{U3}-U=0$ (10−13→0) at $t_5$ of FIG. 6. With this attempt, the adjusted time budge $B_{U4}$ has gone to zero, meaning that the time budget has been fully depleted, and the invention does not attempt another recycle, but instead enters the lockout mode. Therefore in this example, the invention performed two (2) recycles before entering lockout.

In another example, the same initialization variables are loaded at the beginning of a call for heat. (B=30, M=10, A=5, I=30). Upon successful ignition, the actual time for ignition period (U) is determined, and in this example U=24 seconds. Therefore the adjusted time budget $B_{U1}$ is 6 seconds (30−24=6), as illustrated at $t_1$ in FIG. 7. The invention then enters recycle mode (recycle #1) in order to re-establish ignition.

Figure 7:
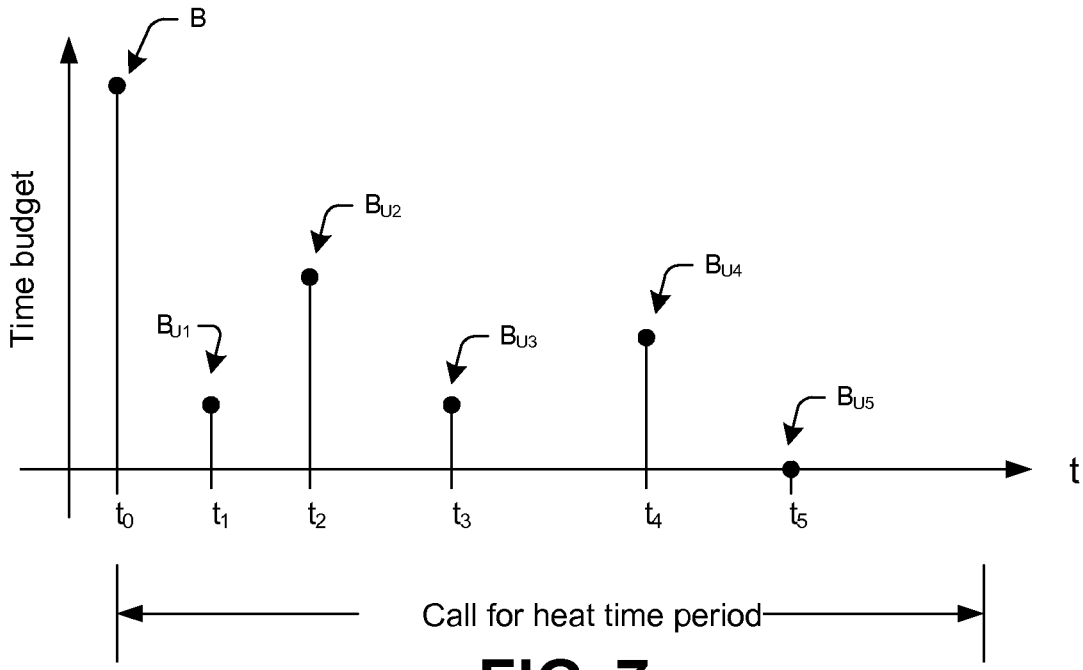

If the flame is maintained successfully for 85 seconds in this example, then the adjusted time budget is adjusted upward at $t_2$, wherein $B_{U2}=B_{U1}+(X/I)A$. If X=85 and I=30, then (X/I) is 2 (with dropped remainder), and thus $B_{U2}=6+(2)(5)=16$ seconds, as illustrated in FIG. 7. Since the flame did go out, and there is still a call for heat, the invention performs another recycle operation (recycle #2) in order to re-establish flame. If the actual trial for ignition period (U) is 9 seconds, then the adjusted time budget is adjusted down by 10 seconds, since M>U, and $B_{U3}=B_{U2}-M=16-10=6$ seconds.

The flame is then successfully maintained for 35 seconds before loss of combustion. Therefore the time budget is again adjusted upwards by 5 seconds, since X/I=35/30=1 (with dropped remainder), and $B_{U4}=B_{U3}+(X/I)A=6+(1)(5)=11$ seconds. The invention then again attempts to re-establish ignition upon entering the recycle mode (recycle #3). If the actual time for ignition period (U) is then 15 seconds, the adjusted time budget BU5 goes to zero, since $B_{U5}=B_{U4}-U=11-15\rightarrow 0$. With the adjusted time budget depleted, the invention controller enters the locket mode.

As can be seen in the above examples, the invention performs recycling an indeterminate number of times before a lockout operation. Rather than counting the number of recycle operations and entering lockout once a predetermined number is reached, the invention uses a time budget, and intelligently adjusts the time budget based on dynamic system conditions.

Although the invention has been illustrated and described with respect to one or more implementations, equivalent alterations and modifications will occur to others skilled in the art upon the reading and understanding of this specification and the annexed drawings. In particular regard to the various functions performed by the above described components (assemblies, devices, circuits, systems, etc.), the terms (including a reference to a "means") used to describe such components are intended to correspond, unless otherwise indicated, to any component which performs the specified function of the described component (e.g., that is functionally equivalent), even though not structurally equivalent to the disclosed structure which performs the function in the herein illustrated exemplary implementations of the invention. In addition, while a particular feature of the invention may have been disclosed with respect to only one of several implementations, such feature may be combined with one or more other features of the other implementations as may be desired and advantageous for any given or particular application. Furthermore, to the extent that the terms "including", "includes", "having", "has", "with", or variants thereof are used in either the detailed description and the claims, such terms are intended to be inclusive in a manner similar to the term "comprising."

What is claimed is:

1. A fuel burner controller configured to establish fuel combustion in a fuel burner, the controller further configured to recycle a fuel combustion initiation process when a loss of combustion is detected and a call for heat is asserted, and further configured to limit a number of recycles of the fuel combustion initiation process based on a time budget, wherein the time budget excludes a predetermined number of recycle attempts the controller further comprising a time budget component configured to variably adjust the time budget from an initial trial for ignition time budget to an adjusted time budget based on an amount of time necessary to achieve combustion in the fuel burner, and initiate a lockout condition if the adjusted time budget reaches a predetermined value.

2. The fuel burner controller of claim 1, wherein the time budget is reduced as a function of time needed to initially establish combustion and re-establish combustion in conjunction with a recycle, and wherein the limit in the number of recycles comprises initiation of a lockout condition when the time budget has been reduced to a predetermined value.

3. The fuel burner controller of claim 1, wherein the controller is configured to recycle a fuel combustion initiation process when a loss of combustion is detected and the call for heat is asserted, and wherein the controller is configured to repeat the recycle process upon further losses of combustion until the adjusted time budget reaches the predetermined value.

4. The fuel burner controller of claim 1, further comprising a trial for ignition monitor configured to ascertain the amount of time necessary to achieve combustion, and wherein the time budget component is configured to reduce the initial time budget based on the ascertained amount of time.

5. The fuel burner controller of claim 4, further comprising a memory location configured to store an initial trial for ignition time budget value and a time budget decrement value, wherein the time budget component is configured to subtract a larger one of the decrement value and the ascertained time necessary to achieve combustion to form the adjusted time budget, and wherein the time budget component is further configured to initiate the lockout condition if the adjusted time budget is less than or equal to the predetermined value.

6. The fuel burner controller of claim 5, wherein the controller is further configured to initiate the recycle of a fuel combustion initiation process if the adjusted time budget is greater than the predetermined value.

7. The fuel burner controller of claim 5, further comprising a memory location configured to store a combustion interval value and a time budget increment value, and a combustion monitor configured to ascertain an amount of time that combustion is successfully maintained during an uninterrupted call for heat, wherein the time budget component is configured to adjust the adjusted time budget as a function of the combustion interval value, the time budget increment value, and the ascertained combustion time.

8. The fuel burner controller of claim 7, wherein the increment value is A, the combustion interval is I, and the ascertained combustion time is X, and wherein the adjusted time budget is adjusted according to:

adjusted time budget=adjusted time budget+(X/I)A, wherein (X/I) is an integer with a dropped remainder, if necessary.

9. A fuel burner system, comprising:

a combustion subsystem configured to initiate a combustion of fuel delivered thereto;

a fuel delivery subsystem configured to selectively deliver fuel to the combustion system; and a fuel burner controller configured to output a combustion control signal to the combustion subsystem to establish combustion upon a call for heat, and output a recycle control signal to the combustion subsystem when a loss of combustion is detected during the call for heat, and further configured to output a signal to limit a number of recycles based on a time budget, wherein the time budget excludes a predetermined number of recycle attempts wherein the controller further comprises a time budget component configured to variably adjust the time budget from an initial trial for ignition time budget to an adjusted time budget based on an amount of time necessary to achieve combustion in the fuel burner, and initiate a lockout condition if the adjusted time budget reaches a predetermined value.

10. The fuel burner system of claim 9, wherein the fuel burner system comprises an oil burner system.

11. The fuel burner system of claim 9, wherein the fuel burner system comprises a gas burner system.

12. The fuel burner system of claim 9, wherein the controller is further configured to adjust the time budget as a function of time needed to initially establish combustion and re-establish combustion in conjunction with a recycle, and wherein the limit in the number of recycles comprises initiation of a lockout condition when the time budget has a predetermined relationship with a predetermined value.

13. The fuel burner system of claim 9, wherein the controller is configured to recycle a fuel combustion initiation process when a loss of combustion is detected and the call for heat is asserted, and wherein the controller is configured to repeat the recycle process upon further losses of combustion during the call for heat until the adjusted time budget reaches the predetermined value.

14. The fuel burner system of claim 9, wherein the controller further comprises a trial for ignition monitor configured to ascertain the amount of time necessary to achieve combustion, and wherein the time budget component is configured to reduce the initial time budget based on the ascertained amount of time from the trial for ignition monitor.

15. The fuel burner system of claim 14, wherein the controller further comprises a memory location configured to store an initial trial for ignition time budget value and a time budget decrement value, wherein the time budget component is configured to subtract a larger one of the decrement value and the ascertained time necessary to achieve combustion to form the adjusted time budget, and wherein the time budget component is further configured to initiate the lockout condition if the adjusted time budget is less than or equal to the predetermined value.

16. The fuel burner system of claim 15, wherein the controller further comprises a memory location configured to store a combustion interval value and a time budget increment value, and a combustion monitor configured to ascertain an amount of time that combustion is successfully maintained during an uninterrupted call for heat, wherein the time budget component is configured to adjust the adjusted time budget as a function of the combustion interval value, the time budget increment value, and the ascertained combustion time.

17. The fuel burner system of claim 16, wherein the increment value is A, the combustion interval is I, and the ascertained combustion time is X, and wherein the adjusted time budget is adjusted according to:

adjusted time budget=adjusted time budget+(X/I)A, wherein (X/I) is an integer with a dropped remainder, if necessary.

* * * * *